US010272007B2

(12) United States Patent
Turner et al.

(10) Patent No.: US 10,272,007 B2
(45) Date of Patent: Apr. 30, 2019

(54) BED FRAME, MATTRESS AND BED WITH ENHANCED CHAIR EGRESS CAPABILITY

(71) Applicant: Hill-Rom Services, Inc., Batesville, IN (US)

(72) Inventors: Jonathan D. Turner, Dillsboro, IN (US); Christopher R. O'Keefe, Columbus, OH (US); Eric R. Meyer, Batesville, IN (US); Richard H. Heimbrock, Cincinnati, OH (US); David W. Hornbach, Brookville, IN (US); Kirill Andrienko, Harrison, OH (US)

(73) Assignee: Hill-Rom Services, Inc., Batesville, IN (US)

( * ) Notice: Subject to any disclaimer, the term of this patent is extended or adjusted under 35 U.S.C. 154(b) by 974 days.

(21) Appl. No.: 14/718,540

(22) Filed: May 21, 2015

(65) Prior Publication Data

US 2015/0250671 A1 Sep. 10, 2015

Related U.S. Application Data

(63) Continuation of application No. 12/890,024, filed on Sep. 24, 2010.

(51) Int. Cl.
*A61G 7/053* (2006.01)
*A61G 7/16* (2006.01)
(Continued)

(52) U.S. Cl.
CPC ..... *A61G 7/16* (2013.01); *A47C 27/001* (2013.01); *A47C 27/14* (2013.01); *A61G 7/015* (2013.01); *A61G 7/053* (2013.01); *A61G 7/0514* (2016.11)

(58) Field of Classification Search
CPC ..... A61G 7/16; A61G 7/015; A61G 7/053; A61G 2007/0514
(Continued)

(56) References Cited

U.S. PATENT DOCUMENTS 25,766 A * 10/1859 Sheidley ..... 5/617
56,211 A * 7/1866 Guyer ..... 5/618
(Continued)

FOREIGN PATENT DOCUMENTS

DE 102009014307 B3 9/2010

OTHER PUBLICATIONS

European Search Report, accompanied by Examiner's Preliminary Opinion, "Application No. EP 11182603", Frank Behammer (Examiner) (dated Dec. 9, 2011), Munich.

*Primary Examiner* — Peter M. Cuomo
*Assistant Examiner* — Ifeolu A Adeboyejo
(74) *Attorney, Agent, or Firm* — Kenneth C. Baran

(57) ABSTRACT

A bed frame 36 disclosed herein includes a calf section 72 with a foot end 74 and an upper end 76 longitudinally spaced from the foot end, an upper body section 54 with a head end 56 and a lower end 58 longitudinally spaced from the head end, and a medial section 66 longitudinally intermediate the calf and upper body sections. The bed frame is capable of assuming a chair state and a chair egress state. The upper body section and medial section define a sacral corner 68, and the calf section and medial section define a popliteal corner 70 spaced from the sacral corner by an intercorner distance. The intercorner distance is smaller in the chair egress state than in the chair state. A mattress 100 disclosed herein includes an upper body segment 102, a calf segment 116, and a medial segment 124 The lower end 106 of the upper body segment cooperates with the upper end 120 of the calf segment to define an intersegment distance. The
(Continued)

mattress has a chair state in which the intersegment distance is a distance $D_1$ and an egress state in which the intersegment distance is a distance $D_2$ which is less than $D_1$. A bed disclosed herein includes a frame whose intercorner distance is smaller in the chair egress state than in the chair state, and a mattress having a medial segment which is conformable to accommodate smaller and larger intercorner distances.

8 Claims, 20 Drawing Sheets

(51) Int. Cl.
*A61G 7/05* (2006.01)
*A61G 7/015* (2006.01)
*A47C 27/00* (2006.01)
*A47C 27/14* (2006.01)

(58) Field of Classification Search
USPC ..... 5/613, 616, 617, 618
See application file for complete search history.

(56) References Cited

U.S. PATENT DOCUMENTS 399,049 A * 3/1889 Keller ..... 297/375
597,480 A * 1/1898 Fellows ..... 297/19
814,272 A * 3/1906 Carr ..... 5/617
839,237 A * 12/1906 Visger ..... 5/617
1,608,848 A * 11/1926 Gallowitz ..... 108/102
3,281,141 A * 10/1966 Smiley et al. ..... 5/614
3,467,971 A * 9/1969 Wieland ..... 5/611
3,640,566 A * 2/1972 Hodge ..... 297/68
3,868,103 A * 2/1975 Pageot et al. ..... 5/614
4,120,057 A * 10/1978 Neumann ..... 5/616
4,247,091 A * 1/1981 Glowacki et al. ..... 5/602
4,371,996 A * 2/1983 Nahum ..... 5/618
4,403,357 A * 9/1983 Degen ..... 5/618
4,521,927 A * 6/1985 Brunn ..... 5/37.1
4,847,929 A * 7/1989 Pupovic ..... 5/608
5,369,826 A * 12/1994 Ikeda ..... 5/613
5,377,369 A * 1/1995 Shirai ..... 5/236.1
5,388,290 A * 2/1995 Shirai ..... 5/236.1
5,454,126 A 10/1995 Foster et al.
5,469,591 A * 11/1995 Nomura ..... 5/613
6,212,714 B1 4/2001 Allen et al.
6,315,319 B1 * 11/2001 Hanson et al. ..... 280/650
6,647,569 B1 * 11/2003 Tansek ..... 5/186.1
6,701,553 B1 * 3/2004 Hand et al. ..... 5/600
6,742,205 B2 * 6/2004 Dewert ..... 5/618
6,763,536 B2 * 7/2004 Dewert ..... 5/618
6,877,816 B1 * 4/2005 Farmont ..... 297/452.63
6,986,180 B1 * 1/2006 Wilke ..... 5/618
7,009,353 B2 * 3/2006 Dewert ..... 318/467
7,107,636 B2 * 9/2006 Metz et al. ..... 5/426
7,346,946 B2 * 3/2008 Takeuchi ..... 5/617
7,386,901 B2 * 6/2008 Dewert et al. ..... 5/618
7,478,447 B2 * 1/2009 Wilming et al. ..... 5/618
7,484,257 B2 * 2/2009 Schneider et al. ..... 5/716
7,581,265 B1 * 9/2009 Bourgraf et al. ..... 5/618
7,975,335 B2 * 7/2011 O'Keefe et al. ..... 5/616
8,161,586 B2 * 4/2012 Koch et al. ..... 5/608
2002/0162170 A1 * 11/2002 Dewert ..... 5/617
2002/0174487 A1 11/2002 Kramer et al.
2003/0093862 A1 * 5/2003 Hanson et al. ..... 5/613
2003/0093863 A1 * 5/2003 Grove ..... 5/618
2004/0128765 A1 * 7/2004 Osborne et al. ..... 5/600
2004/0177445 A1 9/2004 Osborne
2004/0221391 A1 11/2004 Allen
2004/0226094 A1 * 11/2004 Heimbrock et al. ..... 5/618
2004/0250349 A1 * 12/2004 Rene ..... 5/618
2005/0102755 A1 * 5/2005 Jacobs et al. ..... 5/624
2006/0021144 A1 2/2006 Hornbach et al.
2006/0021145 A1 2/2006 Hornbach et al.
2006/0026762 A1 2/2006 Hornbach et al.
2006/0026765 A1 2/2006 Hornbach et al.
2006/0112488 A1 * 6/2006 Lemire et al. ..... 5/617
2006/0130236 A1 * 6/2006 Dewert et al. ..... 5/616
2006/0143827 A1 * 7/2006 Wilming et al. ..... 5/618
2006/0168729 A1 * 8/2006 Weismiller et al. ..... 5/618
2007/0017029 A1 * 1/2007 Wurdeman ..... 5/618
2007/0067913 A1 * 3/2007 Dewert et al. ..... 5/618
2007/0220677 A1 * 9/2007 Dewert ..... 5/618
2009/0199339 A1 * 8/2009 Barr ..... 5/602
2010/0122415 A1 * 5/2010 Turner et al. ..... 5/618

* cited by examiner

BED FRAME, MATTRESS AND BED WITH ENHANCED CHAIR EGRESS CAPABILITY

TECHNICAL FIELD

The subject matter described herein relates to bed frames, mattresses and beds having a chair egress capability and in which a distance which affects the ease or difficulty of egress is variable. One example application for the frame, mattress or bed is a bed for an occupant in a hospital, other health care facility or home health care setting.

BACKGROUND

Beds of the type used in hospitals, other health care facilities and home health care settings typically have frames comprised of multiple sections, at least some of which are articulable, and a mattress supported on the frame sections. The articulable frame sections can be oriented nonhorizontally to affect the profile of the frame and the mattress. Some articulable beds are versatile enough that they can be placed in a chair mode in which the bed profile mimics that of a chair. Such beds are referred to as chair beds. The chair mode is not necessarily intended to enable occupant egress or ingress at the foot end of the bed. However some chair beds feature, in addition to a chair mode, a chair egress mode which is designed to enable occupant egress and ingress at the foot end of the bed. The chair egress mode, in comparison to the chair mode, typically features a lower overall height of the frame sections relative to the floor, and frame section angular orientations more favorable for egress. In addition, if the mattress is an air mattress, the portion of the mattress underneath the occupant's buttocks and thighs and behind the occupant's calves may be deflated to facilitate egress.

Although the chair egress mode is suitable for occupant egress, the occupant's center of gravity may nevertheless be too far behind his heels to be optimum for transitioning from a sitting posture to a standing posture or vice versa. It is, therefore, desirable to provide a chair bed with a chair egress capability that allows more suitable positioning of the occupant's center of gravity during egress and ingress.

SUMMARY

A bed frame disclosed herein includes a calf section with a foot end and an upper end longitudinally spaced from the foot end, an upper body section with a head end and a lower end longitudinally spaced from the head end, and a medial section longitudinally intermediate the calf and upper body sections. The bed frame is capable of assuming a chair state and a chair egress state. In both the chair state and the chair egress state the foot end of the calf section is at a lower elevation than the upper end of the calf section, the head end of the upper body section is at a higher elevation than the lower end of the upper body section, the upper body section and medial section define a sacral corner, and the calf section and medial section define a popliteal corner spaced from the sacral corner by an intercorner distance. The intercorner distance is smaller in the chair egress state than in the chair state.

A mattress disclosed herein includes an upper body segment, a calf segment, and a medial segment. The lower end of the upper body segment cooperates with the upper end of the calf segment to define an intersegment distance. The mattress has a chair state in which the intersegment distance is a distance $D_1$ and an egress state in which the intersegment distance is a distance $D_2$ which is less than $D_1$. The medial segment spans the intersegment distance in both the chair and chair egress states.

A bed disclosed herein includes a frame whose intercorner distance is smaller in the chair egress state than in the chair state, and a mattress having a medial segment which is conformable to accommodate smaller and larger intercorner distances.

BRIEF DESCRIPTION OF THE DRAWINGS

The foregoing and other features of the various embodiments of the bed frame, mattress and bed described herein will become more apparent from the following detailed description and the accompanying drawings in which.

DETAILED DESCRIPTION

Figure 1:
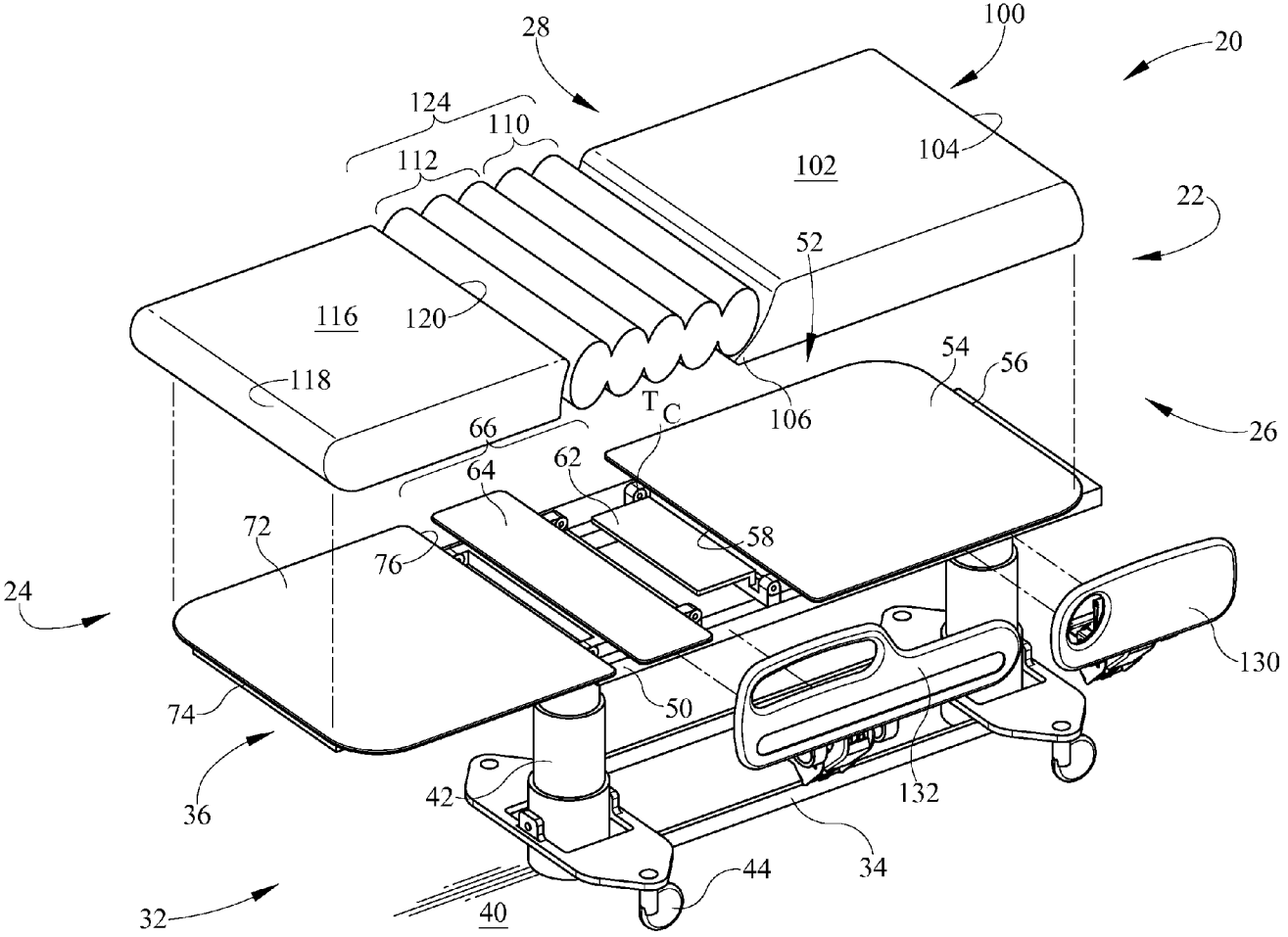
FIG. 1 is a simplified, partially exploded perspective view of a hospital bed including an elevatable frame, a four section deck, and a mattress shown in a flat state but transitionable to a chair state and a chair egress state.
Figure 2:
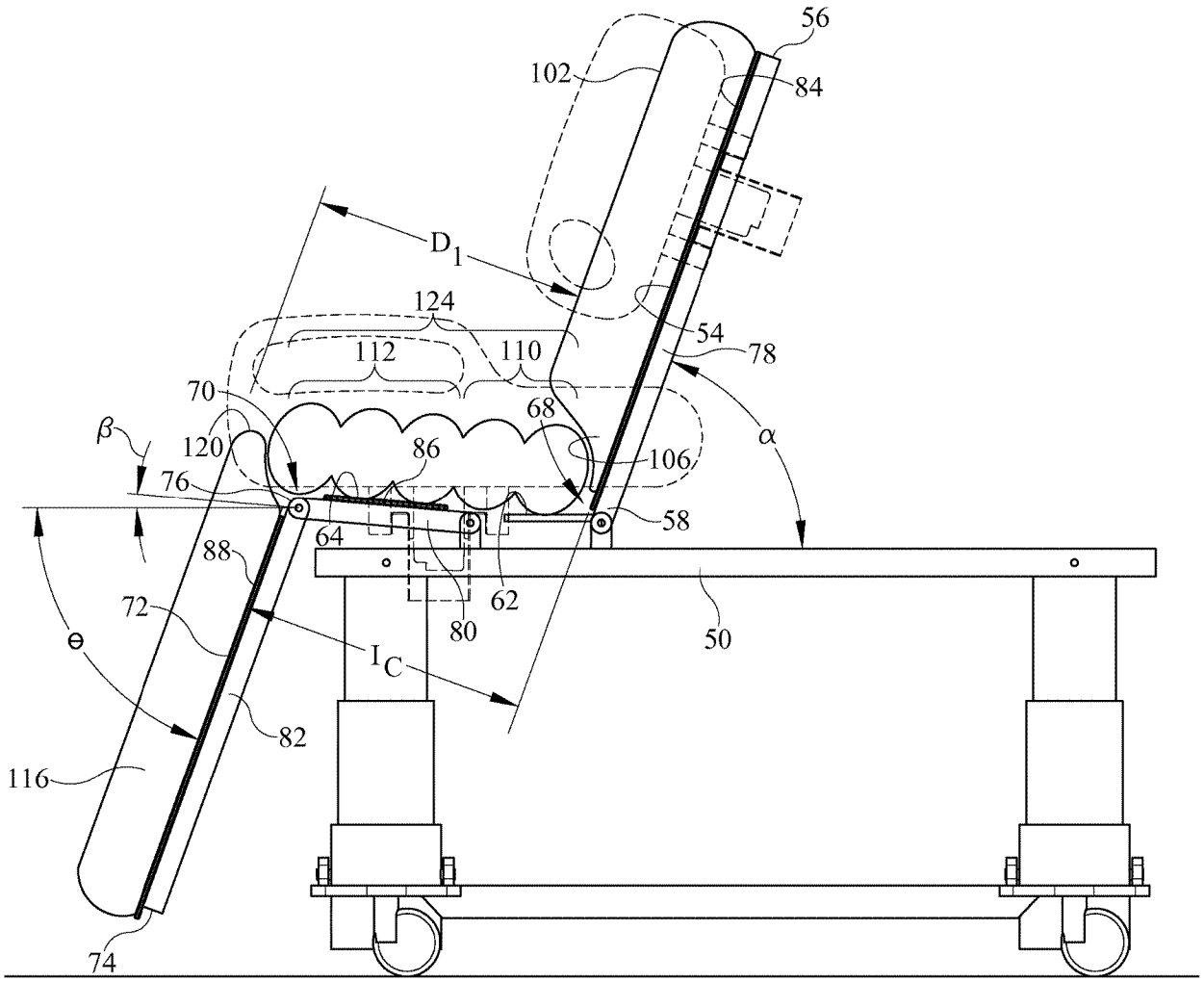
FIG. 2 is a side elevation view of the bed of FIG. 1 shown in the chair state.
Figure 3:
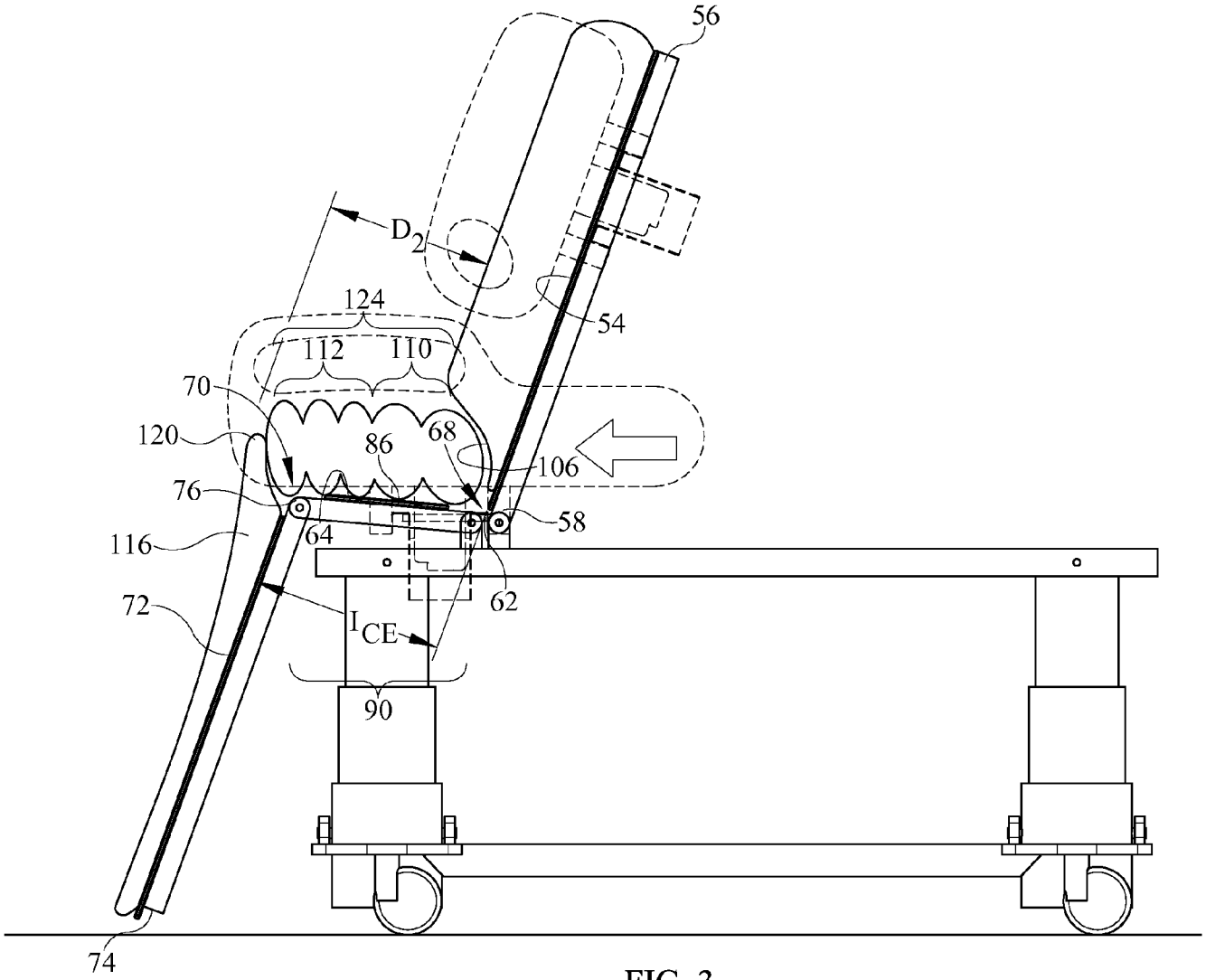
FIG. 3 is a side elevation view similar to that of FIG. 2 with the bed shown in the chair egress state.

Referring to FIGS. 1-3 a hospital bed 20 extends longitudinally from a head end 22 to a foot end 24 and laterally from a left side 26 to a right side 28. The bed includes a framework 32 comprising a base frame 34, and an elevatable frame 36 supported on the base frame by a lift system which can be operated to change the elevation of the elevatable frame relative to the base frame and floor 40. The principal components of the illustrated lift system reside inside a telescoping canister assembly 42. Casters 44 extend from the base frame to the floor.

Elevatable frame 36 includes a chassis 50 and a deck 52 supported on the chassis. The illustrated deck includes four sections: an upper body section 54 extending longitudinally from a head end 56 to a lower end 58 and corresponding approximately to the torso of a bed occupant, a seat section 62 corresponding approximately to the occupant's buttocks, a thigh section 64 corresponding approximately to the occupant's thighs, and a calf section 72 corresponding approximately to the occupant's calves and feet and extending longitudinally from a foot end 74 to an upper end 76. Collectively, seat and thigh sections 62, 64 comprise a medial section 66 residing longitudinally intermediate the calf and upper body sections. In an alternative construction the medial section does not include distinct seat and thigh sections. Either way, the upper body and medial sections define a sacral corner 68 while the calf and medial sections define a popliteal corner 70.

A typical deck section includes a deck section frame such as upper body section, thigh section and calf section frames 78, 80, 82 and corresponding deck panels such as upper body section, thigh section and calf section panels 84, 86, 88. However other constructions are also possible. For example the illustrated seat deck section 62 does not include distinguishable frame and panel portions.

The bed also includes left and right head end siderails 130 attached to frame 78 of upper body section 54, and left and right foot end siderails 132 attached to the chassis 50 of the elevatable frame. Only the left siderails 130, 132 are depicted on the illustrations.

Figure 2A:
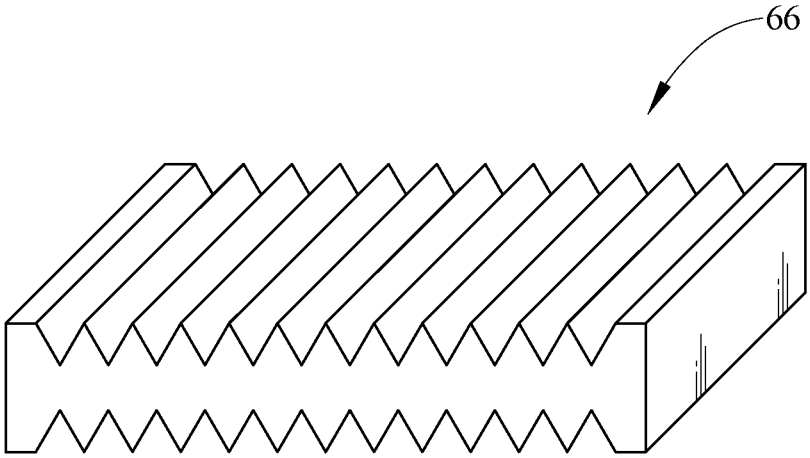
FIGS. 2A-2C are side elevation views of alternate mattress constructions suitable for use on the bed of FIG. 1.
Figure 2B:
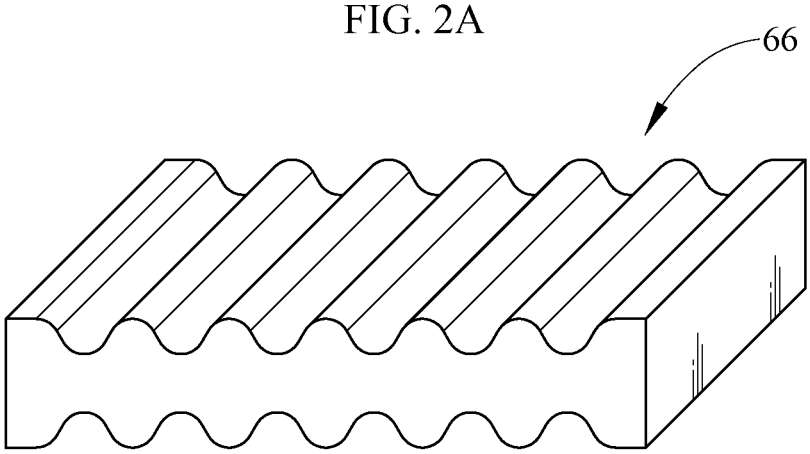
Figure 2C:
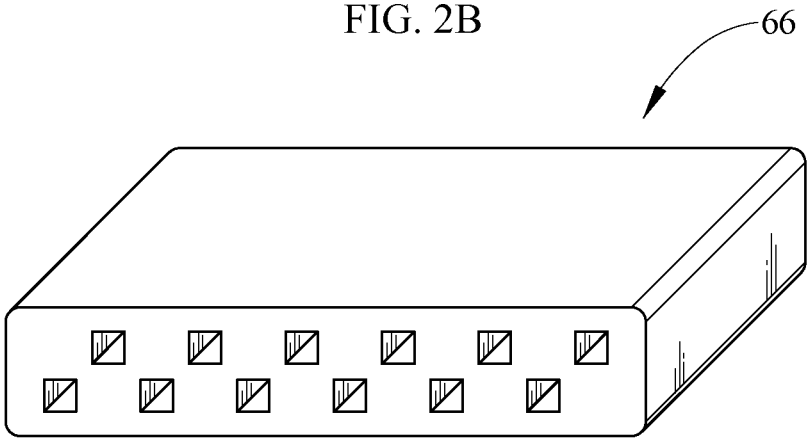

The bed also includes a mattress 100 that rests on the deck sections. Mattress 100 includes an upper body segment 102 extending longitudinally from a head end 104 to a lower end 106 and corresponding to deck upper body section 54, a seat segment 110 corresponding to deck seat section 62, a thigh segment 112 corresponding to deck thigh section 64, and a calf segment 116 extending longitudinally from a foot end 118 to an upper end 120 and corresponding to deck calf section 72. Collectively, the seat and thigh segments comprise a medial segment 124 corresponding to deck medial section 66. At least part of the medial segment is collapsible and expandable. In the illustrated embodiment all of the mattress segments are air bladders that can be pressurized or inflated (FIG. 2) and depressurized or deflated (e.g. bladders 110, 112, 116 of FIG. 3). Hence, the medial segment is collapsible and expandable by virtue of being deflatable and inflatable. Other constructions are also contemplated. For example, FIGS. 2A through 2C show a foam medial segment which is collapsible and expandable due to features such as a sawtooth profile (FIG. 2A), an undulate profile (FIG. 2B), or the presence of perforations (FIG. 2C). The conformable foam and the fluid bladders can be used in combination with each other or individually.

The bed also includes one or more actuators, not shown, for pivoting at least some of the deck sections about a laterally extending pivot axis to adjust the angular orientation of the deck sections, thereby affecting the overall side profile of the frame and mattress. In the illustrated bed the upper body deck section 54, thigh section 64, and calf section 72 can be oriented at angles $\alpha$, $\beta$, and $\theta$ respectively relative to frame chassis 50. FIG. 2 shows the deck sections oriented so that the elevatable frame, and therefore the mattress and bed, assumes a chair state, i.e. a state in which its profile is similar to that of a chair. In the chair state the foot end 74 of calf section 72 is at a lower elevation than the upper end 76 of the calf section, and the head end 56 of upper body section 54 is at a higher elevation than the lower end 58 of the upper body section. The sacral corner 68 is spaced from the popliteal corner 70 by an intercorner distance $I_C$. Lower end 106 of mattress upper body segment 102 is separated from upper end 120 of calf mattress segment 116 by an intersegment distance $D_1$ such that medial segment 124 of the mattress spans across the intercorner distance $I_C$ and across the intersegment distance $D_1$.

Referring to FIG. 3 the elevatable frame, and therefore the mattress and the bed, can also be placed in a chair egress state. In the chair egress state, as in the chair state of FIG. 2, the foot end 74 of the calf section is at a lower elevation than the upper end 76 of the calf section, and the head end 56 of the upper body section is at a higher elevation than the lower end 58 of the upper body section. In addition, one or more actuators has effected a longitudinal translation of the seat section 62 and upper body section 54 relative to the thigh section 64 and calf section 72 so that at least part of the seat section and at least part of the thigh section occupy a common longitudinal region 90. In the specific construction shown in FIG. 3, nearly all of seat section 62 resides underneath thigh deck section panel 86. As a result, in the chair egress state the deck sacral corner 68 is spaced from the deck popliteal corner 70 by an intercorner distance $I_{CE}$ which is less than the intercorner distance $I_C$ of the chair state (FIG. 2). In order to accommodate or conform to the shorter intercorner distance, medial segment bladders 110 and 112 have been at least partially deflated so that lower end 106 of mattress upper body segment 102 is separated from upper end 120 of calf mattress segment 116 by an intersegment distance $D_2$, which is less than the intersegment distance $D_1$ of the chair state (FIG. 2). The medial segment 124 therefore spans across the intersegment distance $D_2$ and the intercorner distance $I_{CE}$. In the illustrated embodiment the calf segment bladder 116 has also been at least partially deflated. Because of the shorter intercorner distance and the accompanying shorter intersegment distance, the occupant's center of gravity is more favorably positioned relative to his feet for egress.

Figure 4:
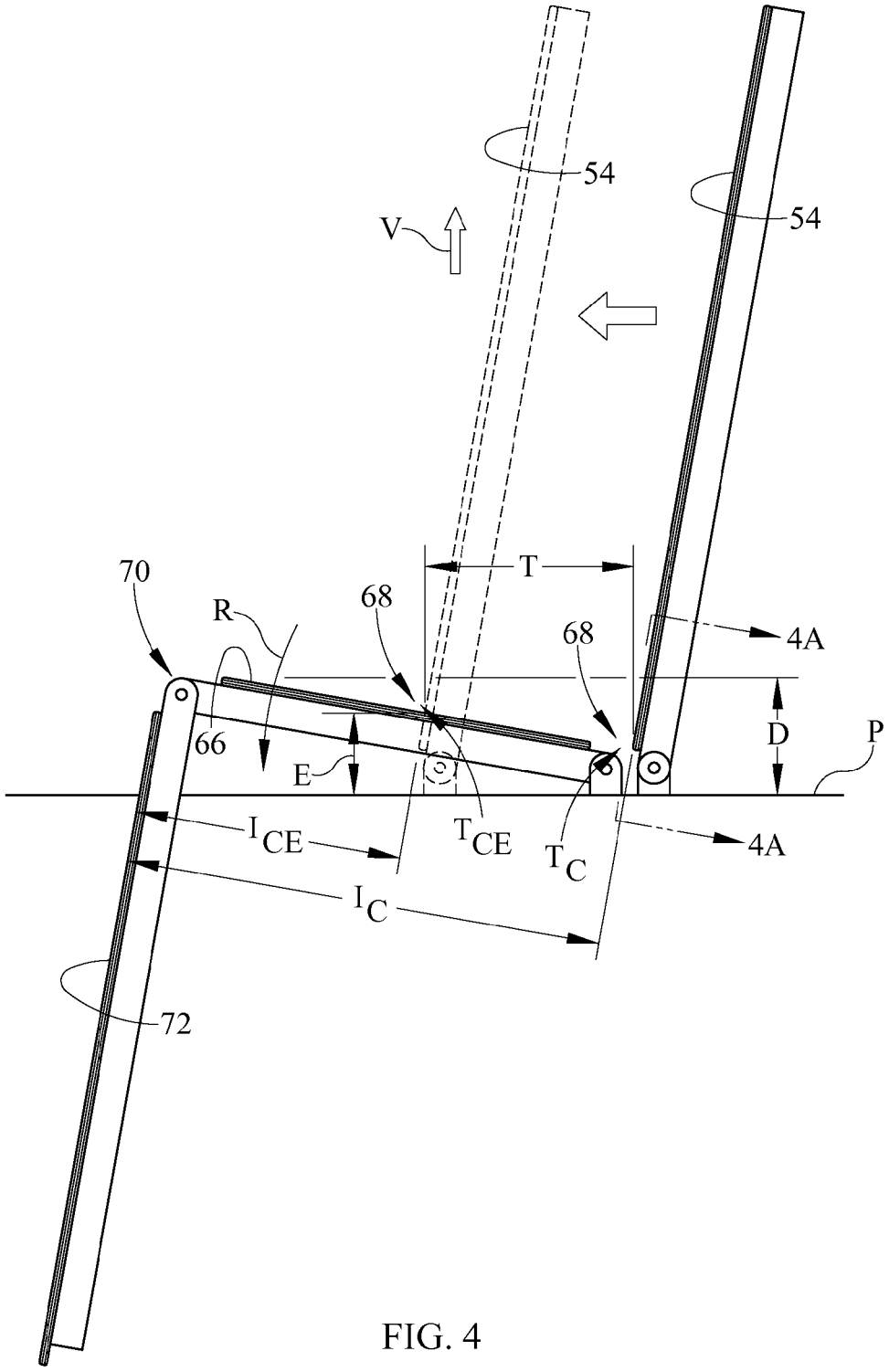
FIG. 4 is a schematic, side elevation view of selected elements of a bed with three deck sections, specifically an upper body section, a medial section and a calf section, and in which transition between the chair state and the chair egress state is effected by relative longitudinal movement of the upper body section and the medial section.
Figure 5:
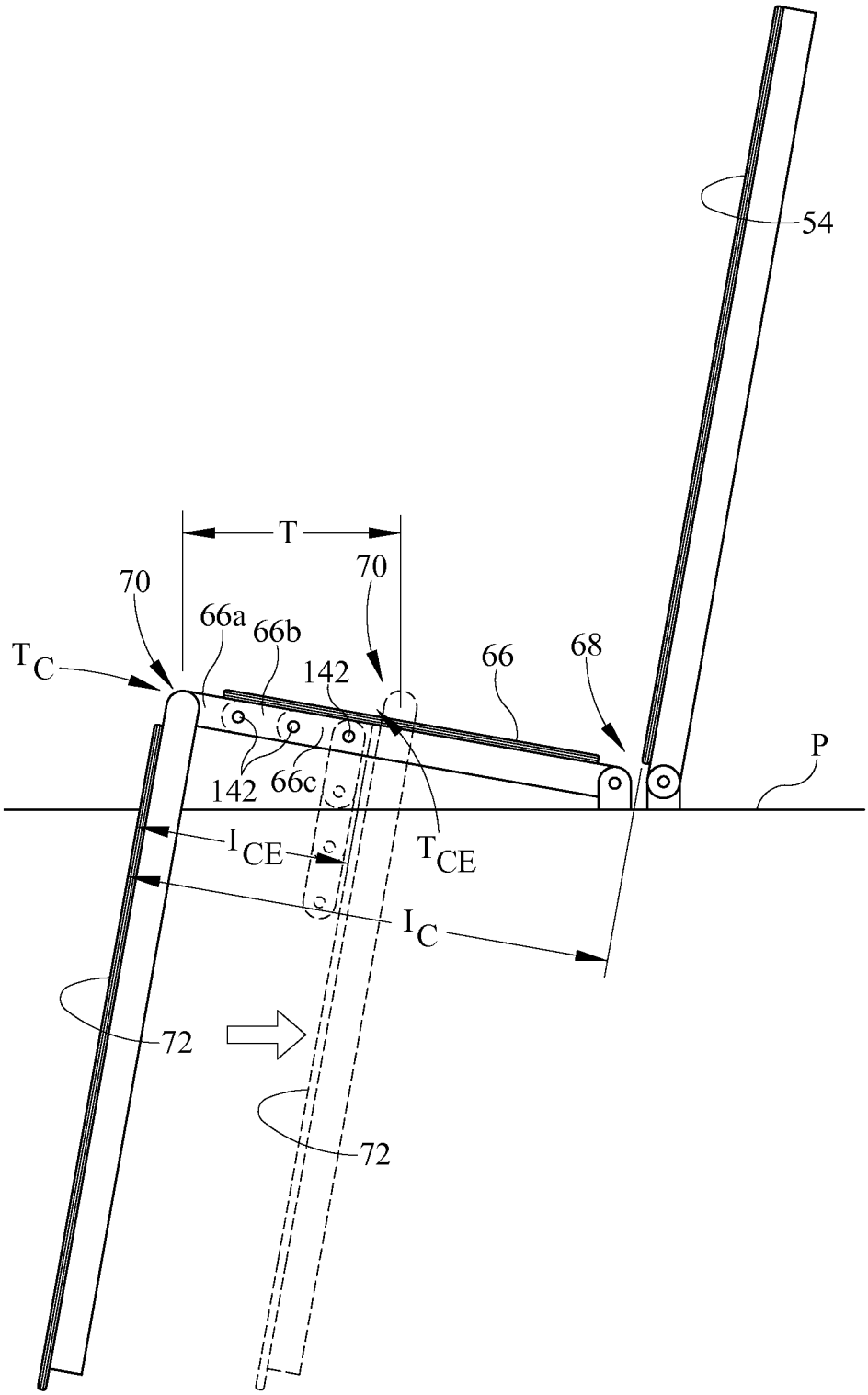
FIG. 5 is a schematic, side elevation view of a bed similar to that of FIG. 4 in which transition between the chair state and the chair egress state is effected by relative longitudinal movement of the calf section and the medial section.

FIGS. 4-10 are schematic, side elevation views showing other options for translating one or more deck sections relative to each other to achieve a chair state with a larger intercorner distance and a chair egress state with a shorter intercorner distance. FIGS. 4-5 illustrate options associated with a three section deck, i.e. one in which medial section 66 is not comprised of distinct seat and thigh sections. FIGS.

6-10 show options associated with a four section deck analogous to that of FIGS. 1-3.

Figure 4A:
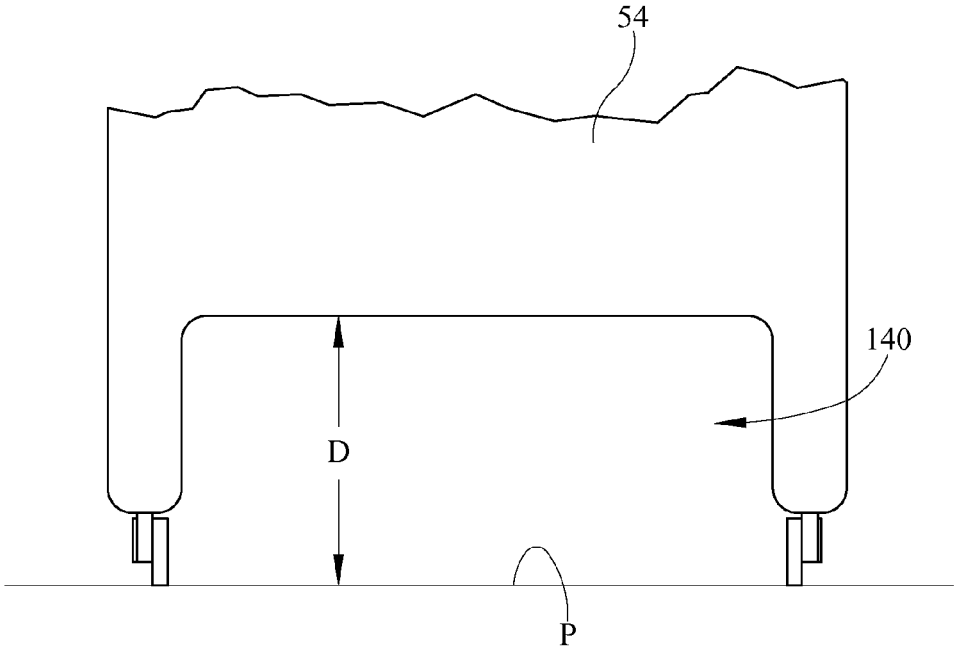
FIG. 4A is a view in the direction 4A-4A of FIG. 4.

In FIG. 4 the difference in intercorner distance depends on relative longitudinal movement between upper body section 54 and medial section 66. Specifically, upper body section 54 translates footwardly by a travel distance T relative to medial section 66 and calf section 72. The deck section translation repositions sacral corner 68 from its initial, chair position $T_C$ to a chair egress position $T_{CE}$ thus reducing the intercorner distance from $I_C$ in the chair state to $I_{CE}$ in the chair egress state. The designer would, of course, make provisions to prevent any interference between deck sections that are translatable relative to each other. For example, upper body section 54 may include a recess 140 (FIG. 4A) whose depth D relative to reference plane P is at least as great as the elevation E (FIG. 4) of the medial section at location $T_{CE}$. Other options include pivoting medial section 66 through an angle as suggested by rotational arrow R and/or elevating upper body deck section 54 as suggested by vertical directional arrow V.

In FIG. 5 the difference in intercorner distance depends on relative longitudinal movement between calf section 72 and medial section 66. Specifically, calf section 72 translates headwardly by a travel distance T relative to medial section 66 and upper body section 54. The deck section translation repositions popliteal corner 70 from its initial, chair position $T_C$ to a chair egress position $T_{CE}$ thus reducing the intercorner distance from $I_C$ in the chair state to $I_{CE}$ in the chair egress state. Provisions for preventing interference between deck sections that are translatable relative to each other could include, for example, a medial section comprised of multiple subsections 66*a*, 66*b*, 66*c* connected by hinges 142 so that the subsections can be incrementally folded down as a function of travel distance T.

Figure 6:
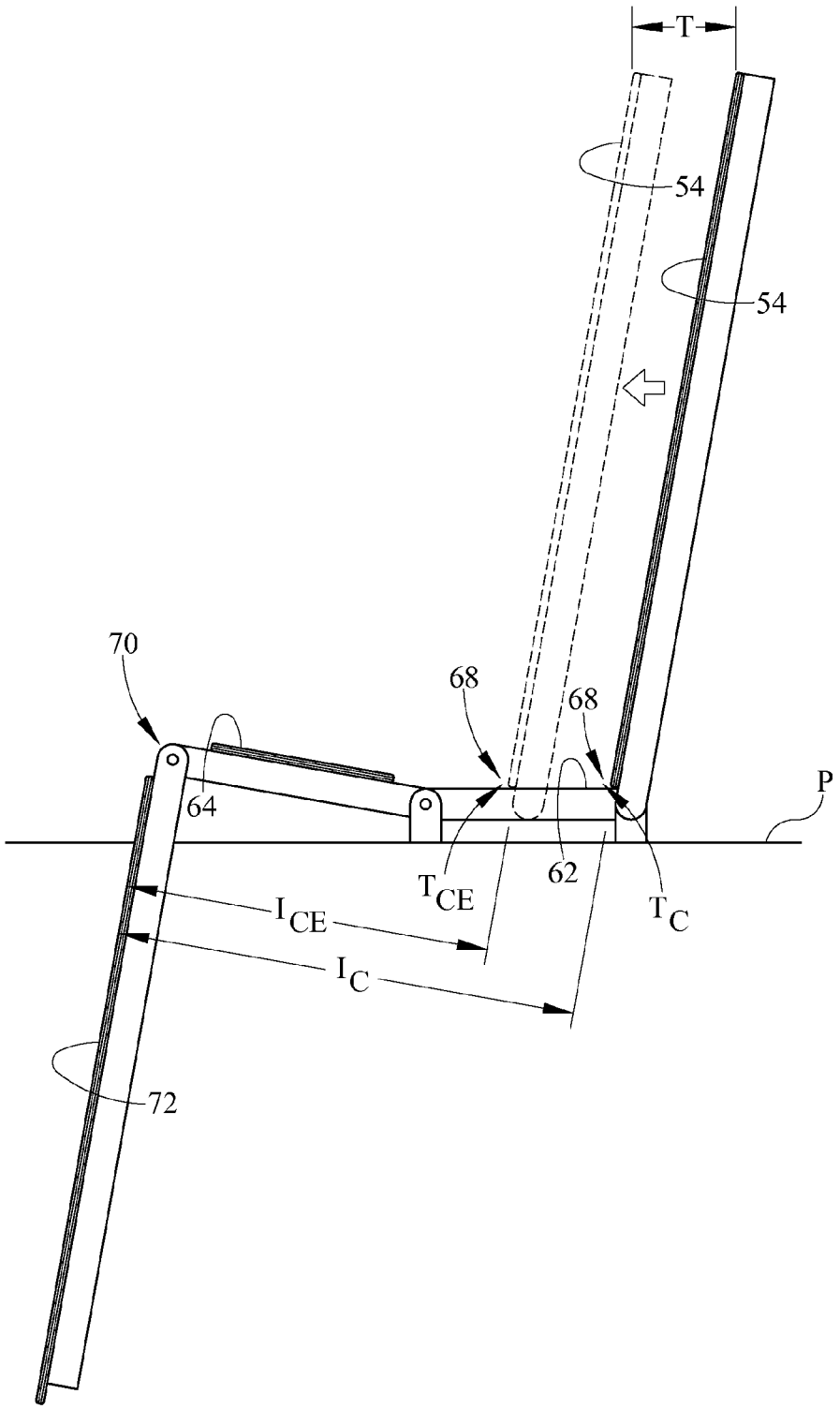
FIG. 6 is a schematic, side elevation view of a bed with four deck sections, specifically an upper body section, a seat section, a thigh section and a calf section, in which transition between the chair state and the chair egress state is effected by relative longitudinal movement between an upper body section and a seat section.

In the four section deck of FIG. 6 the difference in intercorner distance is a function of relative longitudinal movement between upper body section 54 and seat section 62. Specifically, upper body section 54 translates footwardly by a travel distance T relative to seat section 62, thigh section 64 and calf section 72. The deck section translation repositions sacral corner 68 from its initial, chair position $T_C$ to a chair egress position $T_{CE}$ thus reducing the intercorner distance from $I_C$ in the chair state to $I_{CE}$ in the chair egress state. The amount of translation can be more or less than that shown in the illustration. For example, although the illustration shows the sacral corner in the chair egress position being defined by the upper body section and seat section, the relative translation of the deck sections could, if desired, be large enough to cause the sacral corner to be defined by the upper body section and thigh section. If necessary, the bed designer can make provisions to prevent interference between deck sections that are translatable relative to each other. By way of example only, the anti-interference provisions described in the context of FIG. 4 might prove satisfactory.

Figure 7:
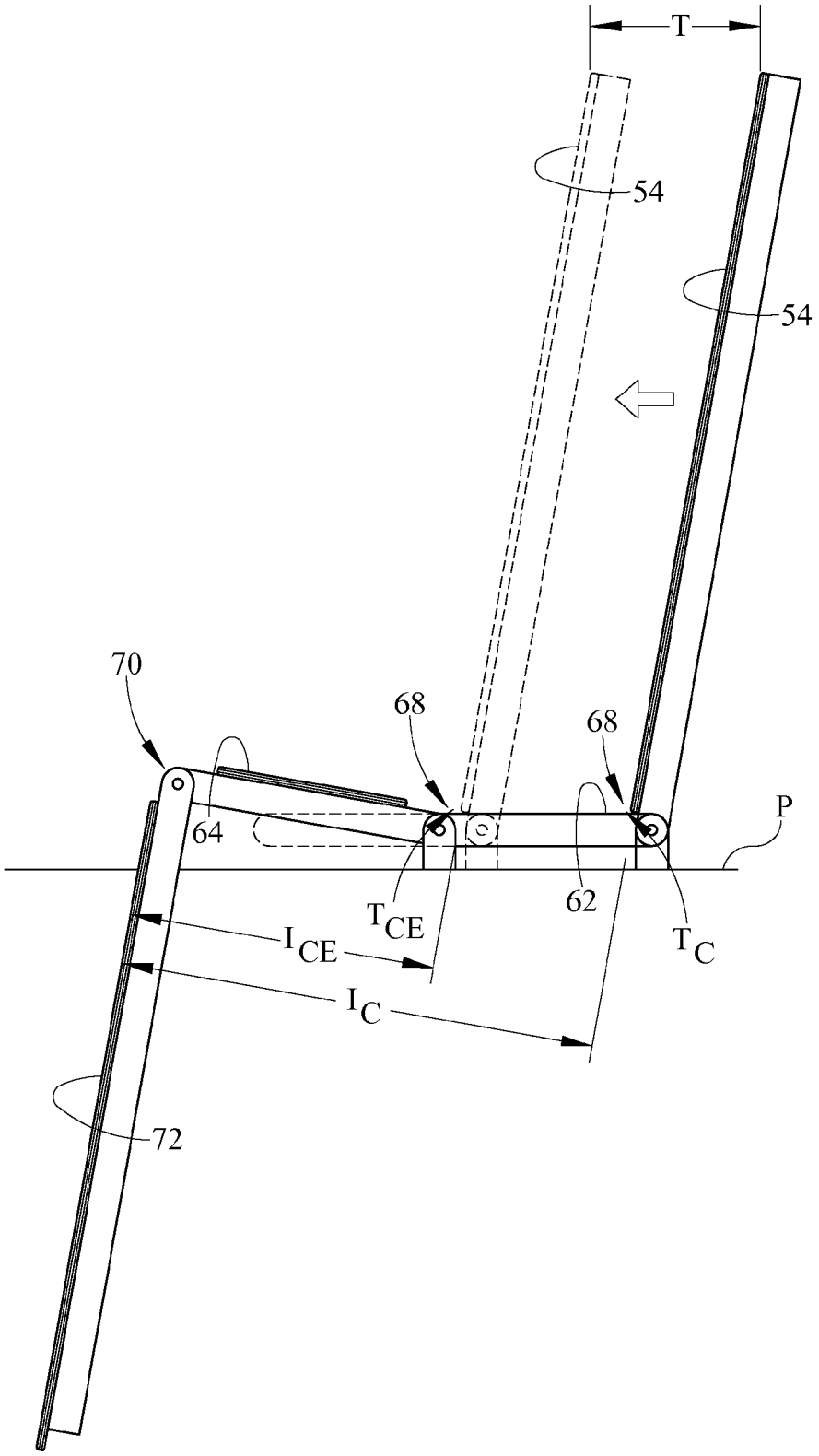
FIG. 7 is a schematic, side elevation view of a bed similar to that of FIG. 6 in which transition between the chair state and the chair egress state is effected by relative longitudinal movement of the upper body section and seat section relative to the thigh section and calf section.

FIG. 7 is a schematic representation of the deck section movements previously described in the context of FIGS. 2 and 3. In FIG. 7 the difference in intercorner distance is a function of relative longitudinal movement of upper body and seat sections 54, 62 relative to thigh section 64 and calf section 72. Specifically, upper body section 54 and seat section 62 translate footwardly as a unit by a travel distance T relative to thigh section 64 and calf section 72. The deck section translation repositions sacral corner 68 from its initial, chair position $T_C$ to a chair egress position $T_{CE}$ thus reducing the intercorner distance from $I_C$ in the chair state to $I_{CE}$ in the chair egress state. As with the embodiment of FIG. 6, the magnitude of the translation can differ from that shown in the illustrations. If necessary, the bed designer can make provisions to prevent interference between deck sections that are translatable relative to each other.

Figure 8:
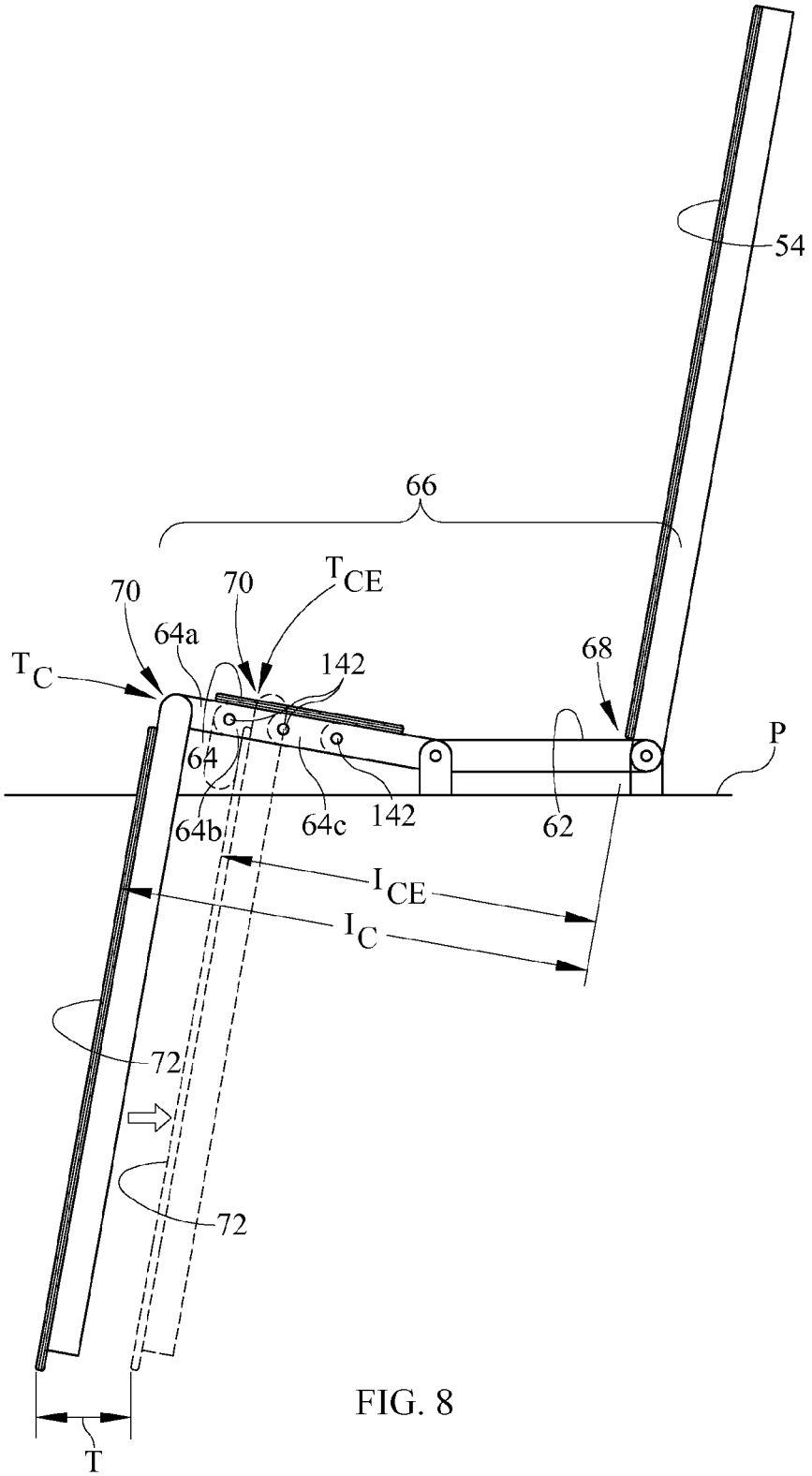
FIG. 8 is a schematic, side elevation view of a bed similar to that of FIG. 6 in which transition between the chair state and the chair egress state is effected by relative longitudinal movement of the calf section relative to the thigh, seat and upper body sections.

In FIG. 8 the difference in intercorner distance is a function of relative longitudinal movement between the thigh and calf sections. Specifically, calf section 72 translates headwardly by a travel distance T relative to thigh section 64, seat section 62 and upper body section 54. The deck section translation repositions popliteal corner 70 from its initial, chair position $T_C$ to a chair egress position $T_{CE}$ thus reducing the intercorner distance from $I_C$ in the chair state to $I_{CE}$ in the chair egress state. As with the embodiment of FIG. 6, the magnitude of the translation can differ from that shown in the illustrations. Provisions for preventing interference between deck sections that are translatable relative to each other could include, for example, a thigh section comprised of multiple subsections 64*a*, 64*b*, 64*c* connected by hinges 142 so that the subsections can be incrementally folded down as a function of travel distance T.

Figure 9:
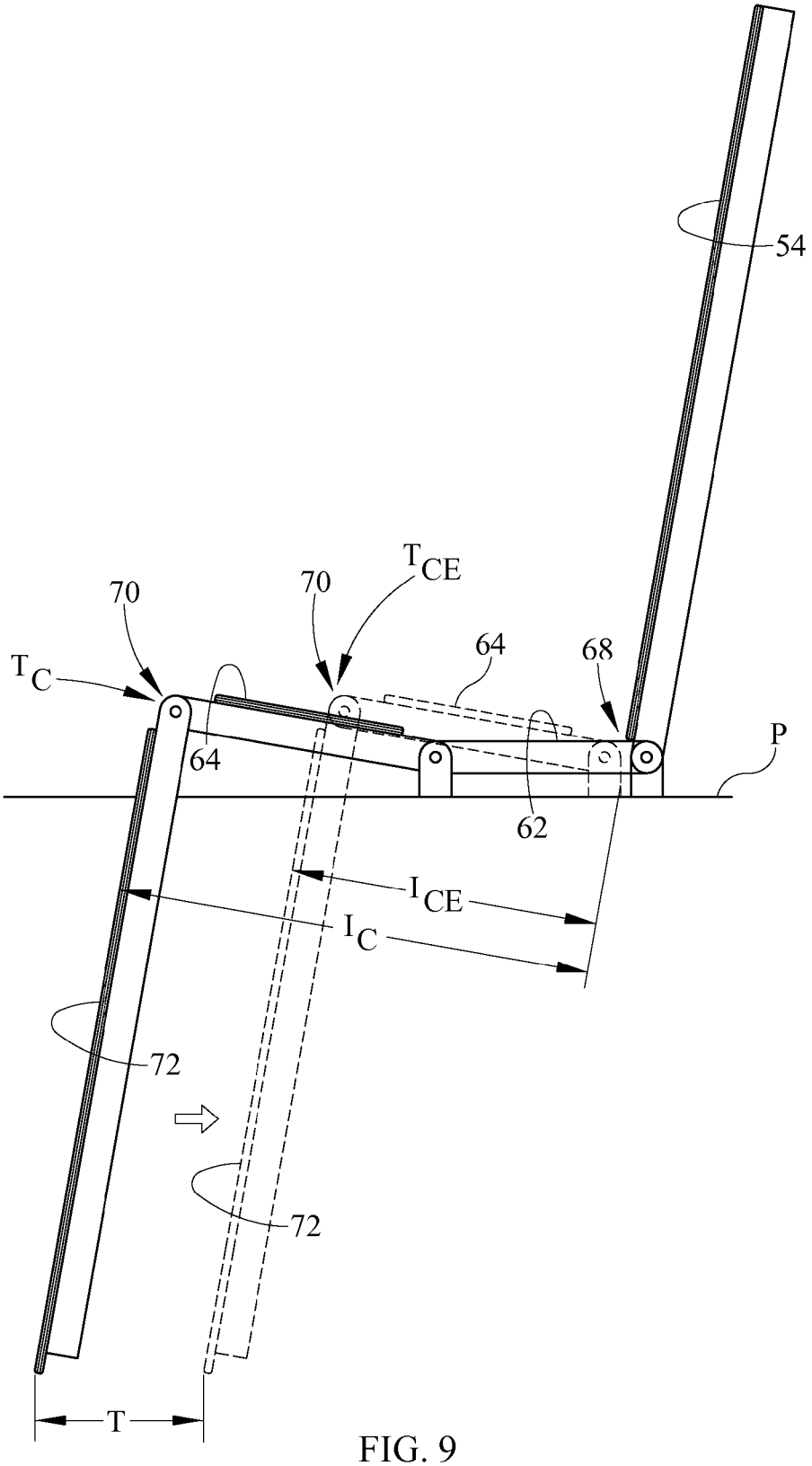
FIG. 9 is a schematic, side elevation view of a bed similar to that of FIG. 6 in which transition between the chair state and the chair egress state is effected by relative longitudinal movement of the thigh and calf sections relative to the seat and upper body sections.

In FIG. 9 the difference in intercorner distance is a function of relative longitudinal movement of the thigh and calf sections 64, 72 relative to the seat section. Specifically, calf section 72 and thigh section 64 translate headwardly as a unit by a travel distance T relative to seat section 62 and upper body section 54. The deck section translation repositions popliteal corner 70 from its initial, chair position $T_C$ to a chair egress position $T_{CE}$ thus reducing the intercorner distance from $I_C$ in the chair state to $I_{CE}$ in the chair egress state. As with the embodiment of FIG. 6, the magnitude of the translation can differ from that shown in the illustrations. If necessary, the bed designer can make provisions to prevent interference between deck sections that are translatable relative to each other.

Figure 10:
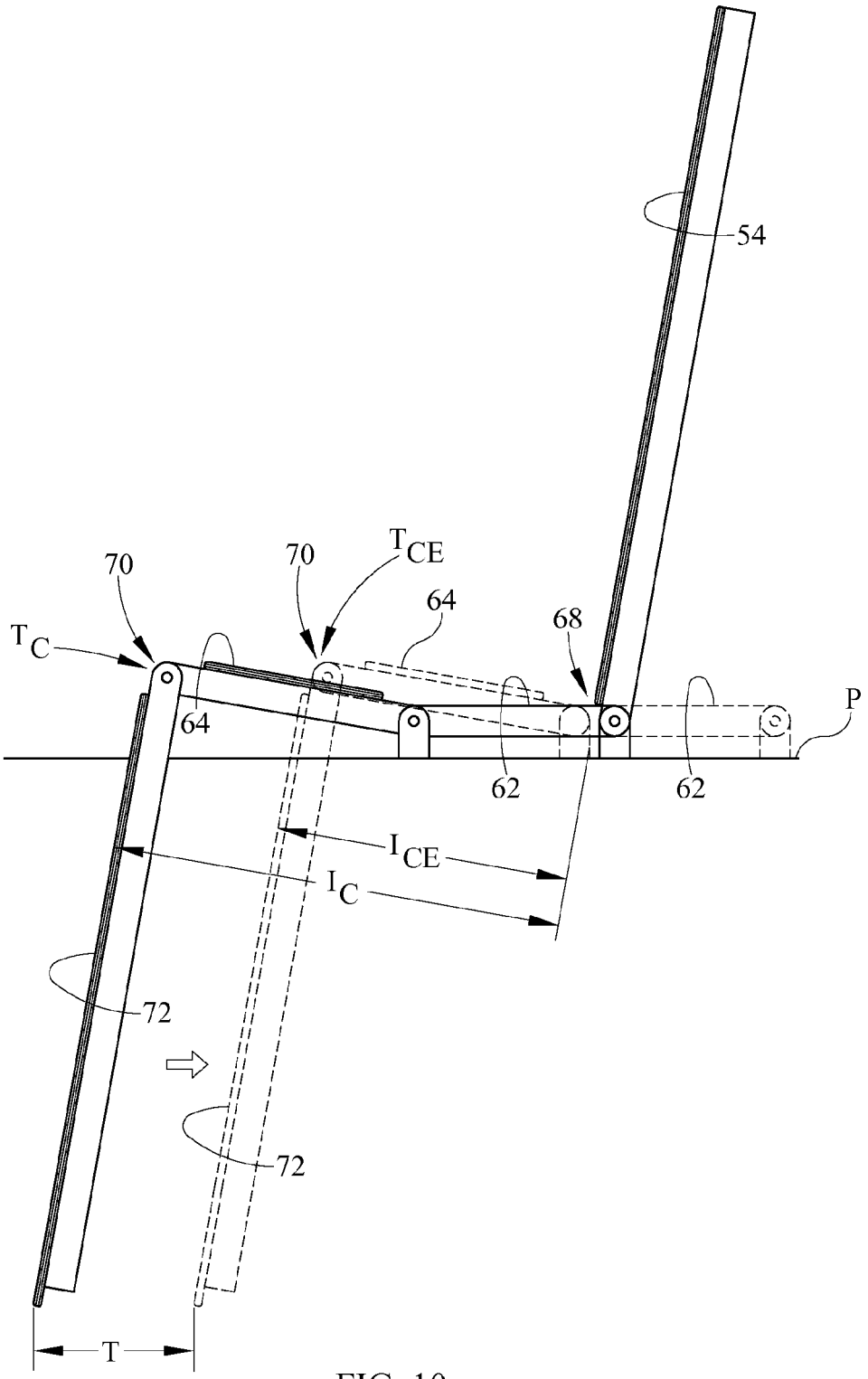
FIG. 10 is a schematic, side elevation view of a bed similar to that of FIG. 6 in which transition between the chair state and the chair egress state is effected by relative longitudinal movement of the seat, thigh and calf sections relative to the upper body section.

In FIG. 10 the difference in intercorner distance is a function of relative longitudinal movement of the seat, thigh and calf sections relative to the upper body section. Specifically, calf section 72, thigh section 64 and seat section 62 translate headwardly as a unit by a travel distance T relative to upper body section 54. The deck section translation repositions popliteal corner 70 from its initial, chair position $T_C$ to a chair egress position $T_{CE}$ thus reducing the intercorner distance from $I_C$ in the chair state to $I_{CE}$ in the chair egress state. As with the embodiment of FIG. 6, the magnitude of the translation can differ from that shown in the illustrations. If necessary, the bed designer can make provisions to prevent interference between deck sections that are translatable relative to each other.

Figure 11A:
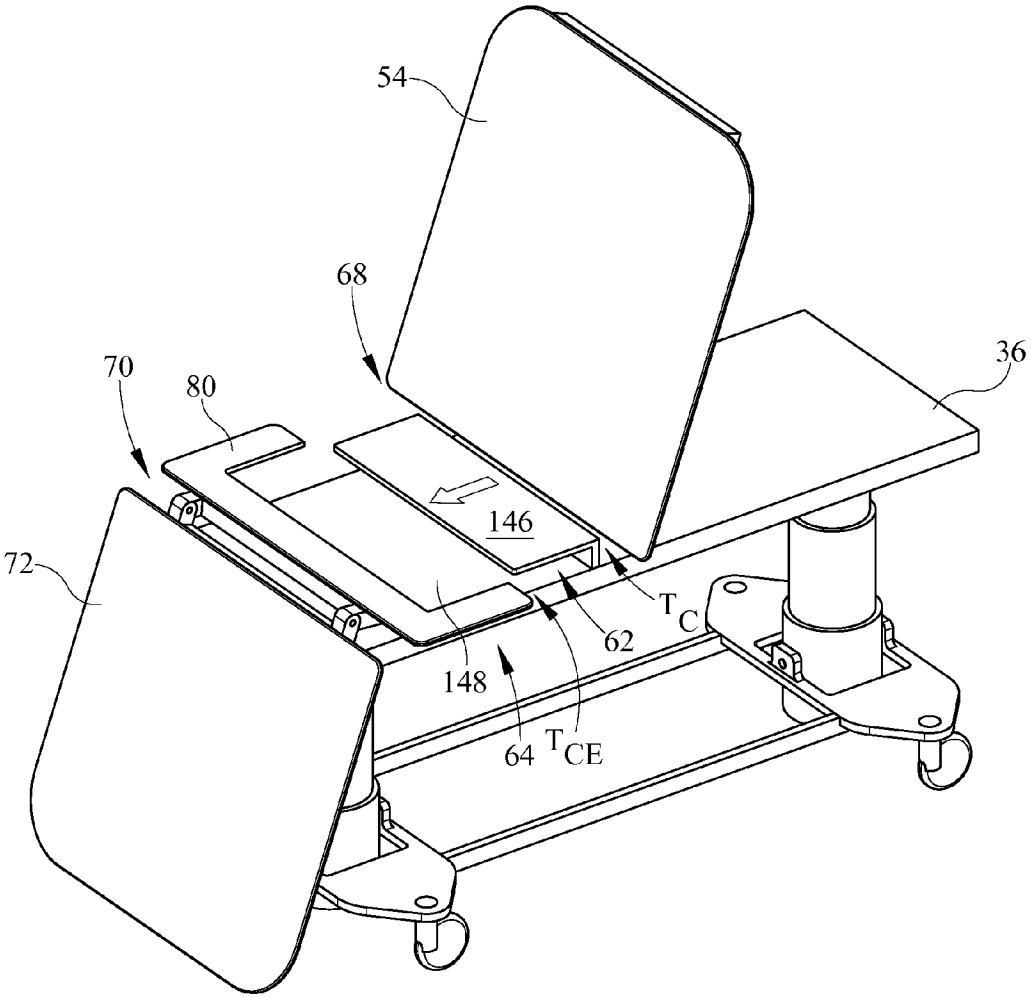
FIGS. 11A and 11B are schematic, perspective views of an embodiment in which the thigh deck section frame borders a receiving space which receives a seat deck section when the bed frame is in the egress state but not when the bed frame is in the chair state.
Figure 11B:
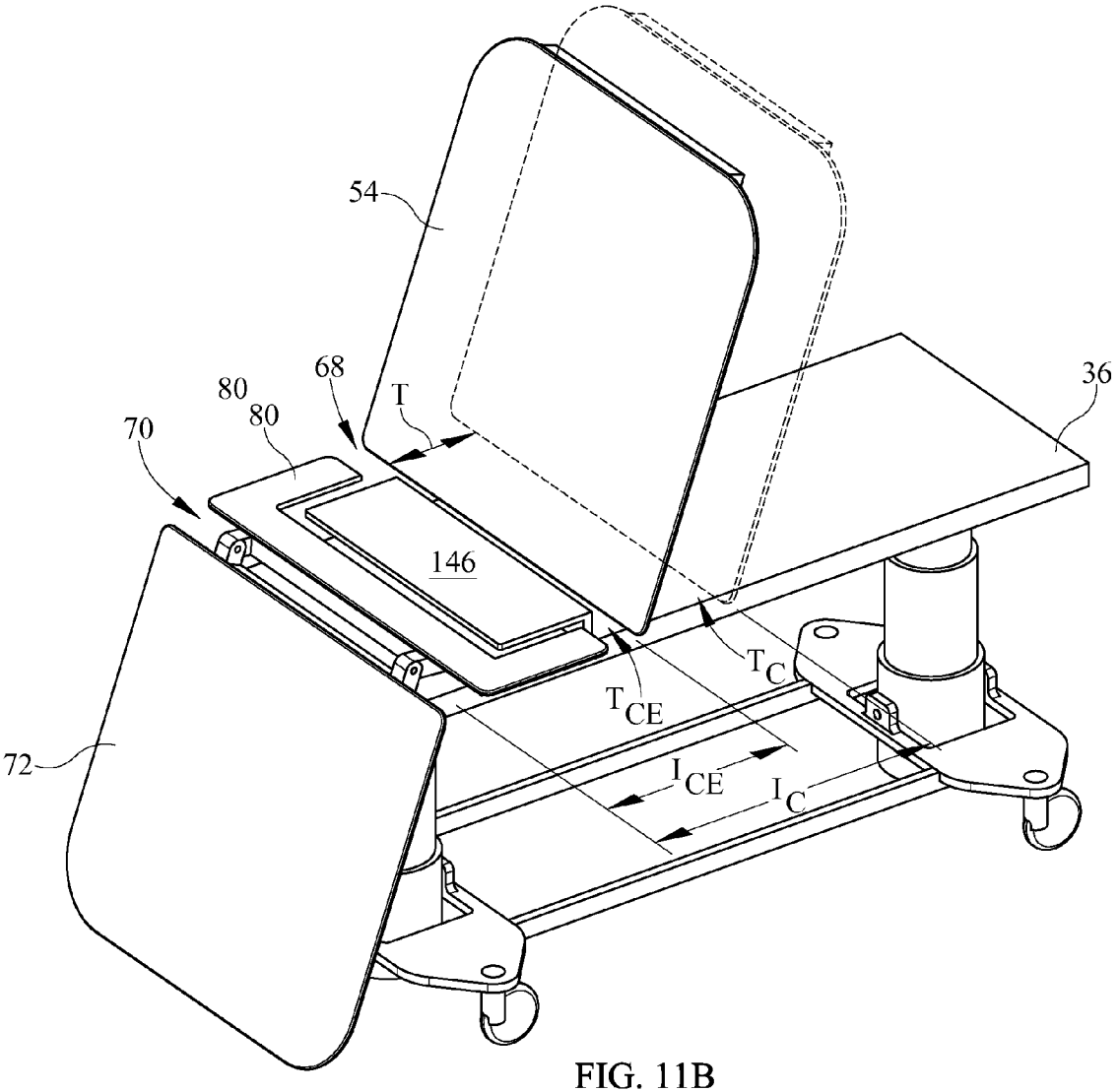

Referring now to FIGS. 11A-11B, in another embodiment elevatable frame 36 includes upper body section 54, seat section 62, thigh section 64 and calf section 72. Seat section 62 includes at least a panel 146. The thigh section includes thigh deck section frame 80, but does not include a thigh deck section panel like panel 86 of FIGS. 2-3. Instead, the mattress used on the frame has sufficient bending resistance to span longitudinally across frame 80 without the assistance of a panel when the bed is not in the chair egress state. Deck section frame 80 borders a receiving space 148 which receives seat deck section 62 when the bed frame is in the egress state (FIG. 11B) but not when the bed frame is in the chair state (FIG. 11A). Relative longitudinal translation of the back section and seat section by a travel distance T relative to the thigh frame and calf section repositions sacral corner 68 from its initial, chair position $T_C$ to a chair egress position $T_{CE}$ thus reducing the intercorner distance from $I_C$ in the chair state to $I_{CE}$ in the chair egress state. If desired the thigh section could have a panel and the seat section could have a frame but no panel, with the frame defining the receiving space for receiving the thigh section panel.

Figure 12A:
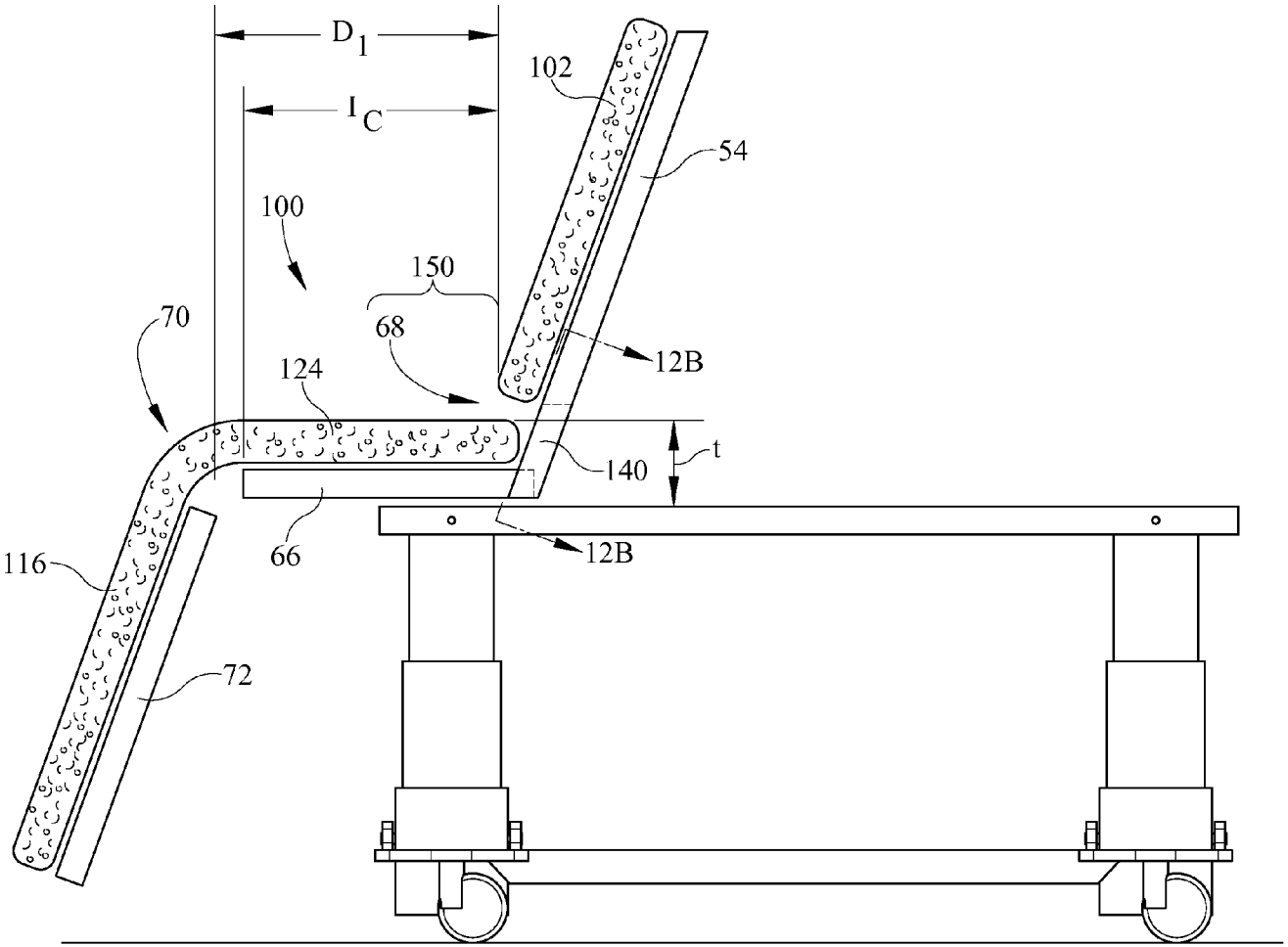
FIGS. 12A-12C are schematic views of a bed embodiment in which the mattress is non-pneumatic and has a length adjustment portion which is deployed for use in the chair state and stored in the chair egress state.
Figure 12B:
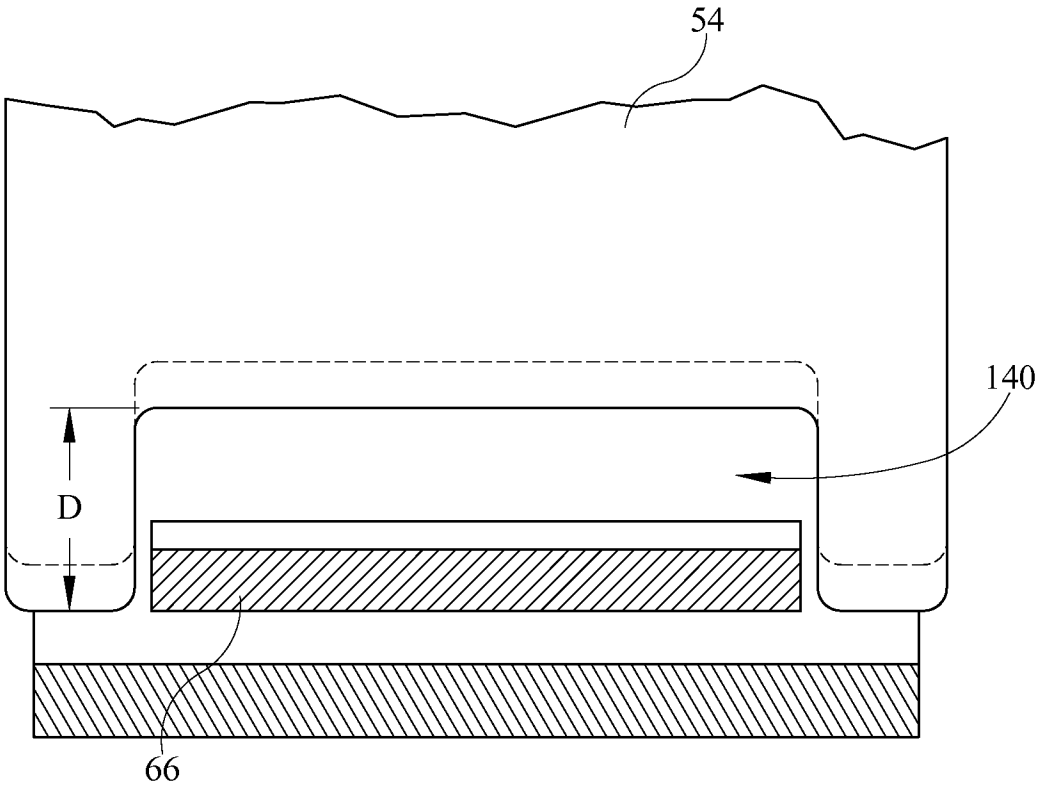
Figure 12C:
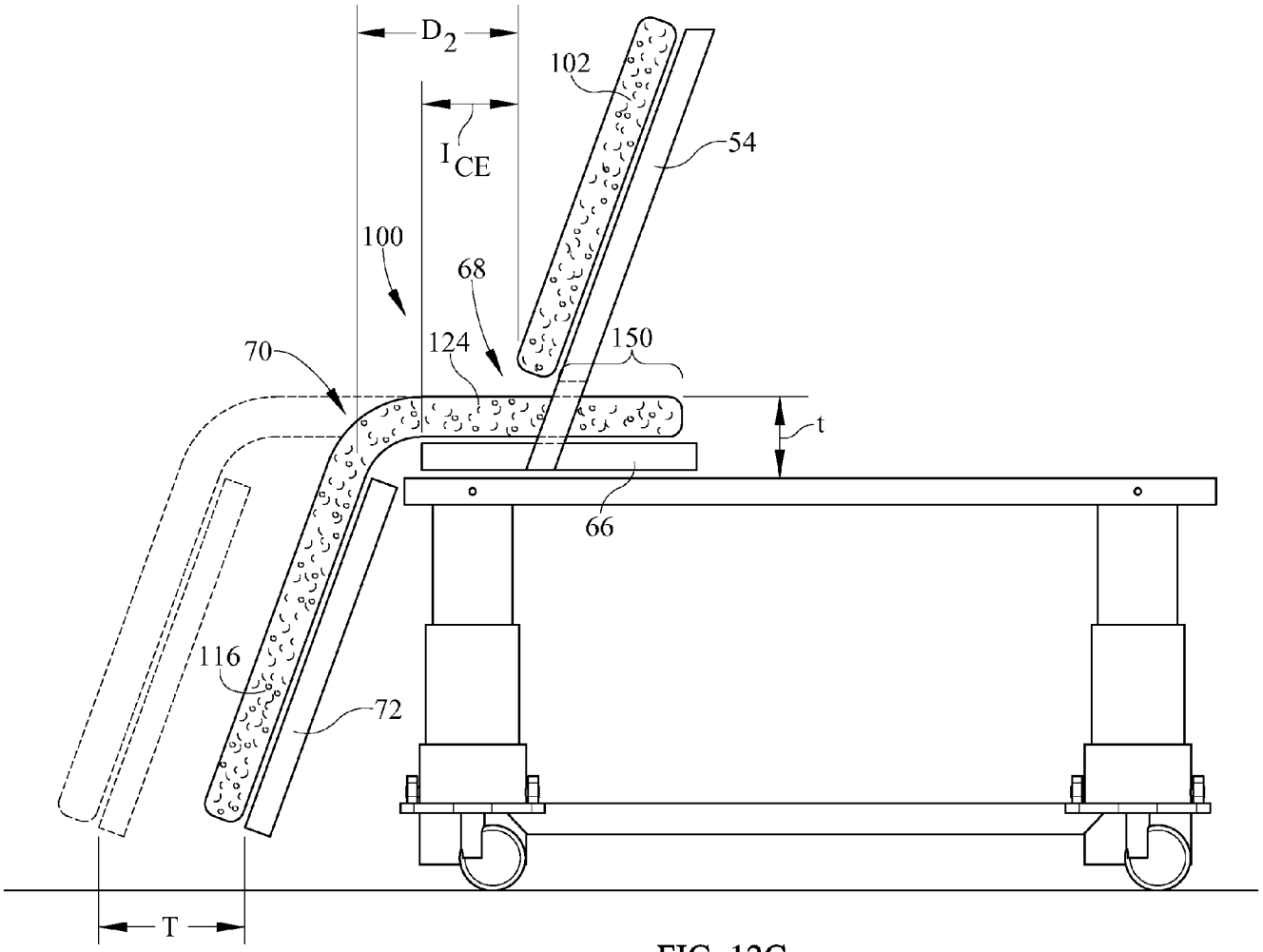

FIGS. 12A-12C show a portion of a bed whose frame includes upper body section 54, medial section 66 and calf section 72. The upper body section includes a recess 140, similar to recess 140 of FIG. 4A, having a depth D. The bed also includes a mattress 100 comprising an upper body segment 102, a medial segment 124 and a calf segment 116. At least part of the medial segment is a non-powered cushion, i.e. a cushion that does not receive or vent air in response to transitions between the chair state and the chair egress state, and therefore is not collapsible and expandable to any appreciable degree. For example the non-powered portion of the mattress medial segment may be a foam cushion. Depth D of upper body section recess 140 is at least as large as the combined thicknesses t of the medial mattress segment 124 and the medial deck section 66. Medial mattress segment 124 has a length adjustment portion 150. In the chair state, the length adjustment portion is deployed for use by the bed occupant so that the mattress intersegment distance $D_1$ and the deck intercorner distance $I_C$ are relatively long. To transition to the chair egress state, the deck medial section 66 and calf section 72 are translated headwardly as a unit by a travel distance T (FIG. 12C) relative to upper body section 54. The deck section translation reduces the intercorner distance to a relatively short distance $I_{CE}$, and carries length adjustment portion 150 of mattress medial segment 124 through recess 140 allowing it to be stored behind the upper body section, thereby reducing intersegment distance to $D_2$ and conforming mattress medial segment 124 to the reduced deck intercorner distance $I_{CE}$. Although the medial segment of FIGS. 12A-12C is shown as a foam cushion, it could take other forms, such as a non-powered, air filled bladder.

Figure 13A:
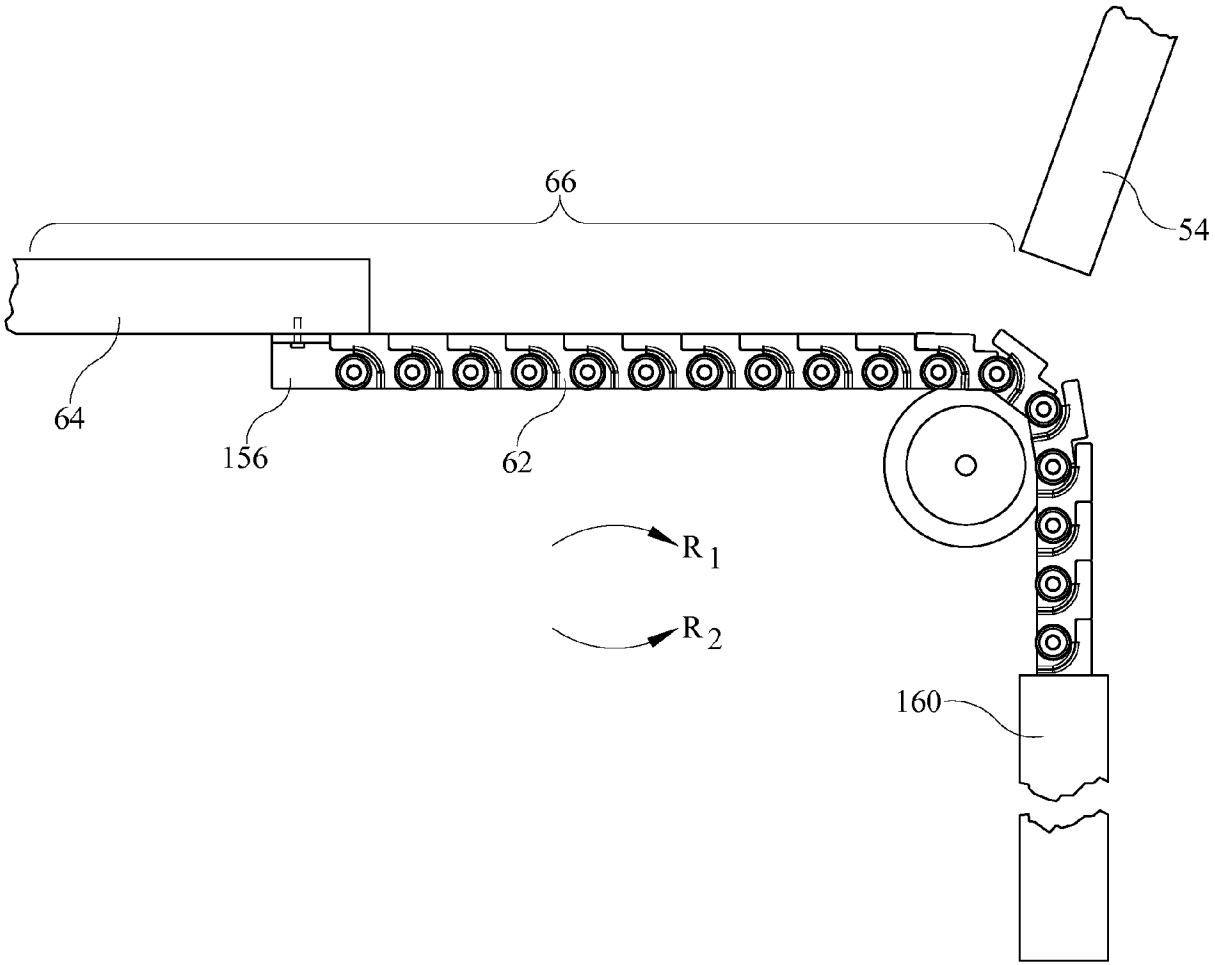
FIGS. 13A-13B are a side elevation view and a plan view of a portion of a bed deck whose seat section is in the form of a series of laterally distributed push chains.
Figure 13B:
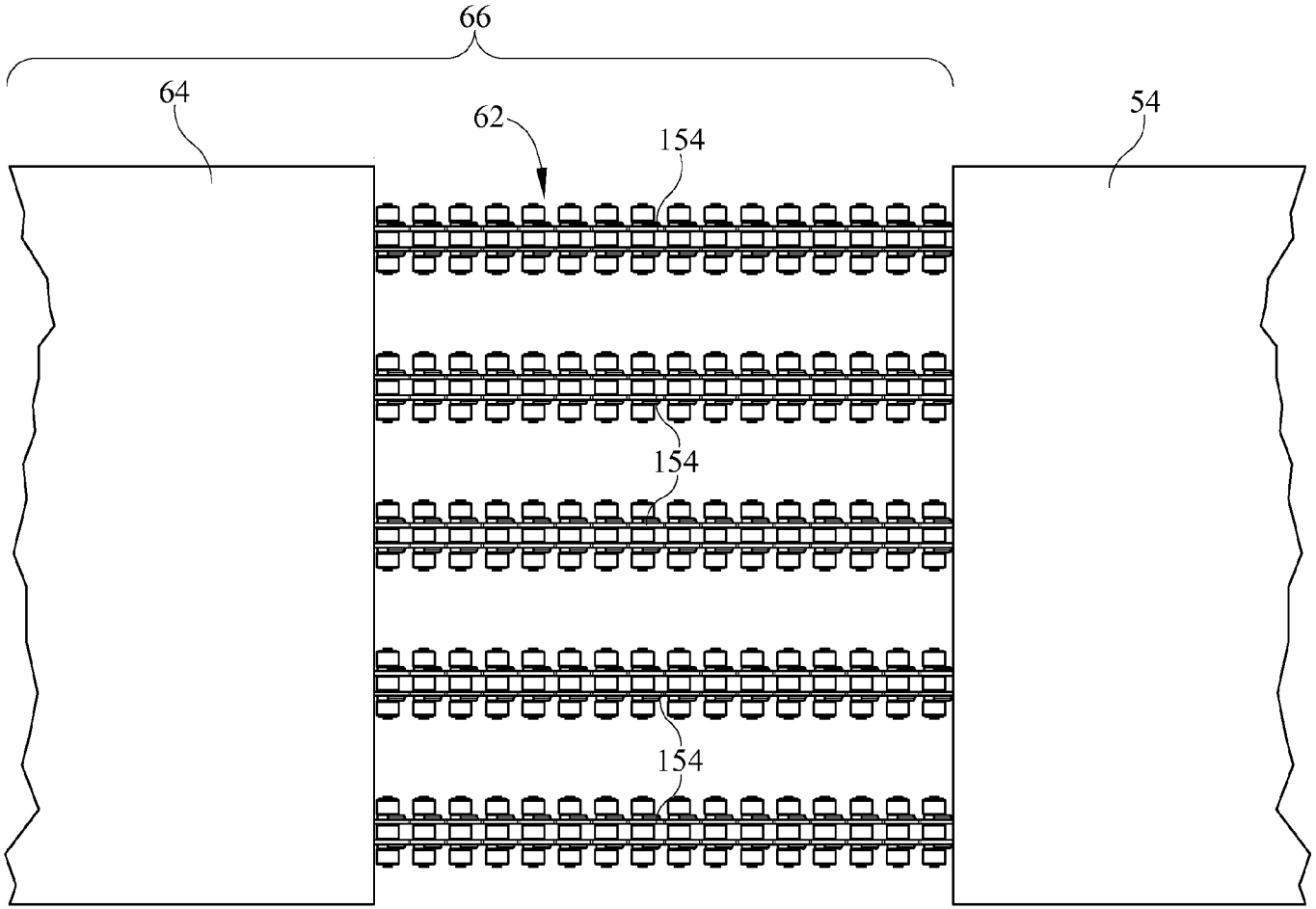
Figure 14:
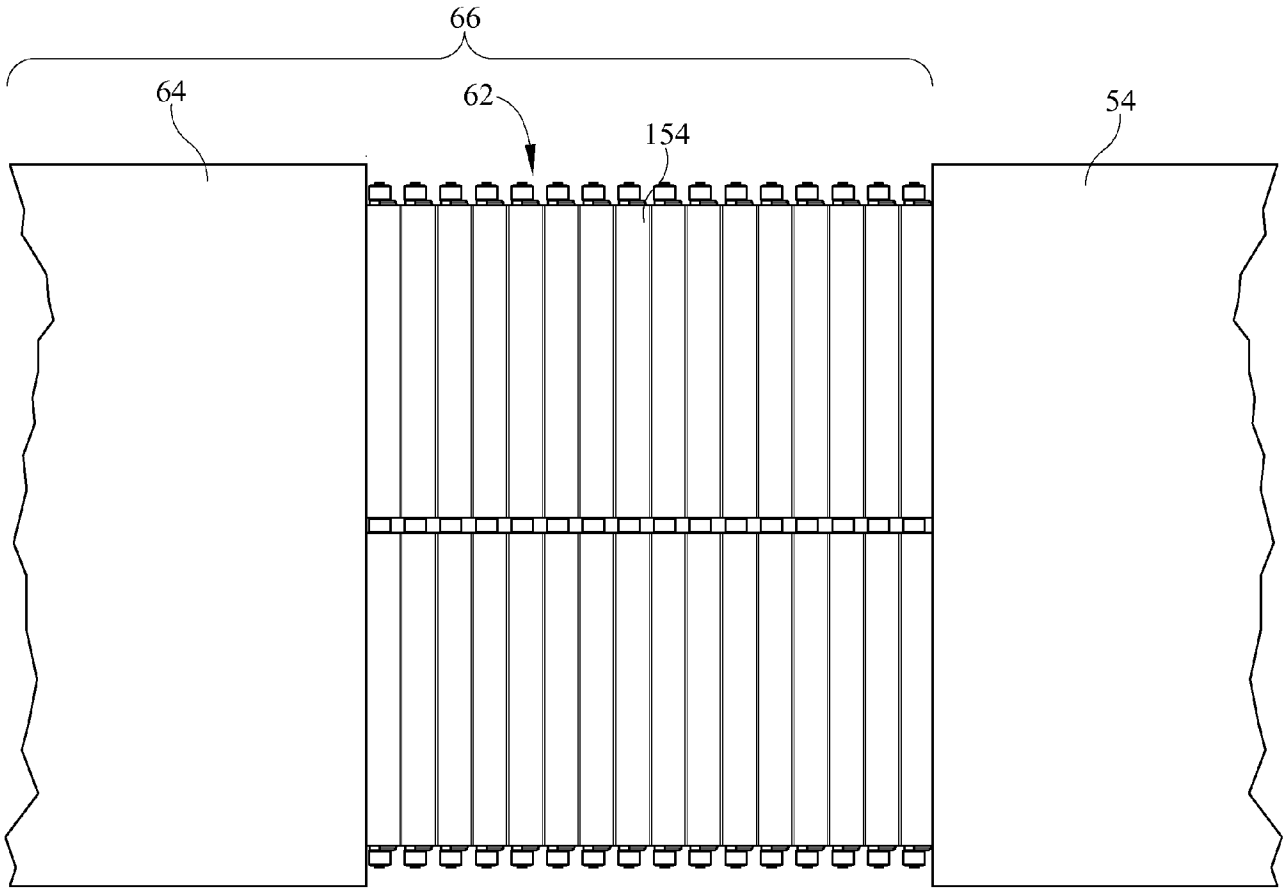
FIG. 14 is a plan view of another embodiment in which the seat section comprises a push chain.

FIGS. 13A-13B shows another option for reducing deck intercorner distance from a larger value $I_C$ in the chair state to smaller value $I_{CE}$ in the chair egress state. FIG. 13 shows a portion of a four section deck comprising upper body section 54, and medial section 66 comprised of thigh section 64 and seat section 62. At least part of the medial section, for example seat section 62 is in the form of a series of laterally distributed push chains 154 whose links are designed so that the chain can flex in the direction indicated by $R_1$, but resists flexure in direction $R_2$. Each push chain is anchored at one of its ends 156 to the deck thigh section 64. The other end resides inside a housing 160 which typically features internal grooves (not visible in the illustration). In operation the chain emerges from the housing to increase the length of the medial section. The chain retracts into the housing, where the internal grooves cause the chain to coil up in a compact space, to decrease the length of the medial section. Alternatively, as seen in FIG. 14, laterally elongated chains (or a single laterally elongated chain) could be used in lieu of the laterally compact, laterally distributed chains of FIGS. 13A and 13B to provide a spatially more continuous support surface.

Although the foregoing description refers to occupant egress, the principles and constructions are equally applicable to occupant ingress. The described options (e.g. those relating to which deck sections are movable, and those relating to anti-interference provisions) are illustrative examples, not an exhaustive collection of possibilities.

The foregoing description describes relative longitudinal translation of a first deck section or sections relative to a second section or sections and illustrates the principles with examples in which the relative translation is the result of the first section or sections translating with respect to the base frame 34 and the second section or sections remaining translationally stationary relative to the base frame. However the relative movement can be accomplished by translating the second section or sections with respect to the base frame while holding the first section or sections stationary with respect to the base frame, or by translating both the first and second sections toward each other by an appropriate amount. Accordingly, reference to relative translation or movement in both the description and the accompanying claims encompass translation of one or both of the section or sections in question by an amount appropriate to alter the intercorner distance.

Although this disclosure refers to specific embodiments, it will be understood by those skilled in the art that various changes in form and detail may be made without departing from the subject matter set forth in the accompanying claims.

We claim:

1. A bed frame comprising:

a calf section having a foot end and an upper end longitudinally spaced from the foot end;

an upper body section having a head end and a lower end longitudinally spaced from the head end;

a medial section longitudinally intermediate the calf and upper body sections;

the bed frame being capable of assuming a chair state and a chair egress state in both of which the foot end of the calf section is at a lower elevation than the upper end of the calf section, the head end of the upper body section is at a higher elevation than the lower end of the upper body section, the upper body section and medial section define a sacral corner, and the calf section and medial section define a popliteal corner spaced from the sacral corner by an intercorner distance;

the intercorner distance being smaller in the chair egress state than in the chair state, and wherein the difference in intercorner distance is a function of relative longitudinal movement of the calf section and medial section.

2. A bed frame comprising:

a calf section having a foot end and an upper end longitudinally spaced from the foot end;

an upper body section having a head end and a lower end longitudinally spaced from the head end;

a medial section longitudinally intermediate the calf and upper body sections, the medial section comprising a thigh section longitudinally headward of the calf section and a seat section longitudinally headward of the thigh section;

the bed frame being capable of assuming a chair state and a chair egress state in both of which the foot end of the calf section is at a lower elevation than the upper end of the calf section, the head end of the upper body section is at a higher elevation than the lower end of the upper body section, the upper body section and medial section define a sacral corner, and the calf section and medial section define a popliteal corner spaced from the sacral corner by an intercorner distance;

the intercorner distance being smaller in the chair egress state than in the chair state, and wherein the difference in intercorner distance is a function of one of:

A) relative longitudinal movement of the upper body section and the seat section, B) relative longitudinal movement of the upper body and seat section relative to the thigh section, C) relative longitudinal movement of the thigh and calf sections, D) relative longitudinal movement of the thigh and calf sections relative to the seat section, E) relative longitudinal movement of the seat, thigh and calf sections relative to the upper body section.

3. A bed frame comprising:

a calf section having a foot end and an upper end longitudinally spaced from the foot end;

an upper body section having a head end and a lower end longitudinally spaced from the head end;

a medial section longitudinally intermediate the calf and upper body sections, the medial section comprising a thigh section longitudinally headward of the calf section and a seat section longitudinally headward of the thigh section;

the bed frame being capable of assuming a chair state and a chair egress state in both of which the foot end of the calf section is at a lower elevation than the upper end of the calf section, the head end of the upper body section is at a higher elevation than the lower end of the upper body section, the upper body section and medial section define a sacral corner, and the calf section and medial section define a popliteal corner spaced from the sacral corner by an intercorner distance;

the intercorner distance being smaller in the chair egress state than in the chair state wherein one of the seat section and the thigh section includes a deck panel, the other of the seat section and the thigh section comprises a deck section frame without a corresponding deck panel, the deck section frame defining a receiving space which receives the deck section panel when the bed frame is in the egress state but not when the bed frame is in the chair state.

4. A mattress comprising:

a calf segment having a foot end and an upper end longitudinally spaced from the foot end;

an upper body segment having a head end and a lower end longitudinally spaced from the head end, the lower end cooperating with the upper end of the calf segment to define an intersegment distance;

a medial segment;

the mattress having a chair state in which the intersegment distance is a distance $D_1$ and an egress state in which the intersegment distance is a distance $D_2$ which is less than D1;

the medial segment spanning the intersegment distance in both the chair and egress states.

5. The mattress of claim 4 wherein at least part of the medial segment is collapsible to accommodate the distance D2 and expandable to accommodate the distance D1.

6. The mattress of claim 5 wherein the collapsible and expandable part comprises at least one of a fluid bladder and a conformable foam section.

7. The mattress of claim 6 wherein the conformable foam section, if present, is rendered conformable by at least one of a sawtooth profile, an undulate profile and a perforated construction.

8. The mattress of claim 4 wherein the medial segment is a cushion having a length adjustment portion which is deployed in the chair state, and which is stored in the egress state.

* * * * *